US006711784B2

(12) United States Patent
Walker

(10) Patent No.: US 6,711,784 B2
(45) Date of Patent: Mar. 30, 2004

(54) HANDLE CONVERSION DEVICE

(75) Inventor: Morris W. Walker, Corvallis, OR (US)

(73) Assignee: Jelmar, Skokie, IL (US)

( * ) Notice: Subject to any disclaimer, the term of this patent is extended or adjusted under 35 U.S.C. 154(b) by 0 days.

(21) Appl. No.: 09/782,469

(22) Filed: Feb. 12, 2001

(65) Prior Publication Data

US 2002/0116790 A1 Aug. 29, 2002

(51) Int. Cl.[7] ..... A45C 13/22

(52) U.S. Cl. ..... 16/436; 24/265 H; 294/165; 294/166

(58) Field of Search ..... 16/422, 436; 24/265 H, 24/600.9; 294/137–172, 165, 166

(56) References Cited

U.S. PATENT DOCUMENTS

| | | | | |
|---|---|---|---|---|
| 270,917 | A | | 1/1883 | Turner |
| 664,814 | A | * | 12/1900 | Manes ..... 24/265 H |
| 707,669 | A | | 8/1902 | Young |
| 725,158 | A | * | 4/1903 | Shephard ..... 24/265 H |
| 2,274,605 | A | | 2/1942 | Hoffmeister |
| 2,339,646 | A | | 1/1944 | Mann |
| 2,540,330 | A | * | 2/1951 | Gries ..... 24/600.9 |
| 3,257,120 | A | | 6/1966 | Browning |
| 3,306,507 | A | | 2/1967 | Wilson |
| 3,578,226 | A | | 5/1971 | Good |
| 3,948,365 | A | | 4/1976 | Gregg et al. |
| 3,982,613 | A | | 9/1976 | Wood |
| 4,004,722 | A | | 1/1977 | Olivier |
| 4,023,762 | A | | 5/1977 | Batts et al. |
| 4,114,838 | A | | 9/1978 | Knauf |
| D256,405 | S | | 8/1980 | Wheeler |
| 4,245,763 | A | | 1/1981 | Weinberg |
| 4,256,320 | A | | 3/1981 | Hager |
| D259,238 | S | | 5/1981 | Schenck, III |
| D268,815 | S | | 5/1983 | Schwalbach |
| 4,420,178 | A | | 12/1983 | Taylor et al. |
| 4,538,709 | A | | 9/1985 | Williams et al. |
| 4,596,397 | A | | 6/1986 | Conti |
| 4,666,203 | A | | 5/1987 | Castro |
| 4,679,670 | A | | 7/1987 | Wickman |
| 4,708,357 | A | | 11/1987 | Soderbaum |
| 4,791,702 | A | | 12/1988 | McVey |
| D303,076 | S | | 8/1989 | Castelli et al. |
| 4,852,705 | A | | 8/1989 | Cowan, Jr. |
| 4,887,825 | A | | 12/1989 | Allen et al. |
| 4,890,355 | A | | 1/1990 | Schulten |
| D316,804 | S | | 5/1991 | Foulke et al. |
| 5,048,649 | A | | 9/1991 | Carpenter et al. |
| 5,249,438 | A | | 10/1993 | Rhaney et al. |
| 5,265,307 | A | | 11/1993 | Hull et al. |

(List continued on next page.)

FOREIGN PATENT DOCUMENTS

| | | | |
|---|---|---|---|
| CA | 2051940 | A | 3/1993 |
| GB | 2171674 | A | 2/1986 |
| GB | 2210776 | | 6/1989 |
| NO | 71134 | | 8/1947 |
| WO | WO 91/12744 | | 9/1991 |
| WO | WO 93/18684 | | 9/1993 |

*Primary Examiner*—Anthony Knight
*Assistant Examiner*—Vishal Patel
(74) *Attorney, Agent, or Firm*—Greenberg Traurig, P.C.

(57) ABSTRACT

A handle conversion device for facilitating movement of a wheeled object which includes a preexisting handle with a grip member having a longitudinal axis positioned in a plane substantially perpendicular to a desired direction of movement. The handle conversion device includes a hand grip, a neck and an attachment portion. The hand grip includes a longitudinal axis orientated substantially perpendicular to the plane occupied by the grip member of the preexisting handle, and substantially within the plane defined by the forward and rearward movement of the wheeled object. The attachment portion includes a hook member and a retention member which, in combination, act to releasably retain the grip member of the preexisting handle, to controllably maintain the substantially perpendicular relationship of the hand grip for the handle conversion device to the preexisting handle.

16 Claims, 2 Drawing Sheets

U.S. PATENT DOCUMENTS

| | | | | | |
|---|---|---|---|---|---|
| 5,319,829 | A | | 6/1994 | Manuel | |
| 5,339,934 | A | | 8/1994 | Liang | |
| 5,351,365 | A | | 10/1994 | Hauck | |
| 5,351,793 | A | | 10/1994 | Gibbs | |
| D356,261 | S | | 3/1995 | Miceli, Jr. | |
| D360,570 | S | | 7/1995 | Lien et al. | |
| 5,441,323 | A | * | 8/1995 | Goddard | 294/137 |
| D362,386 | S | | 9/1995 | Blocker | |
| D362,622 | S | | 9/1995 | Van Davelaar | |
| 5,474,162 | A | | 12/1995 | Shyr et al. | |
| 5,487,581 | A | | 1/1996 | Carmo et al. | |
| 5,507,544 | A | | 4/1996 | McQuade et al. | |
| 5,645,306 | A | | 7/1997 | Kosteniuk | |
| D392,098 | S | * | 3/1998 | Finkelman | D3/315 |
| 5,722,118 | A | * | 3/1998 | Hansen et al. | 16/113.1 |
| 5,878,853 | A | * | 3/1999 | DeRouen et al. | 16/406 |
| 6,000,108 | A | * | 12/1999 | Roan | 24/265 H |
| 6,317,924 | B1 | * | 11/2001 | Gallagher | 16/113.1 |
| 6,360,402 | B1 | * | 3/2002 | Crabtree | 16/422 |

* cited by examiner

HANDLE CONVERSION DEVICE

BACKGROUND OF THE INVENTION

1. Field of the Invention

The present invention relates in general to handles for wheeled objects, such as luggage or suitcases, and, in particular, to a handle conversion device for reorienting the position of a handle used to direct a wheeled object for forward and rearward movement, to minimize arm, wrist and/or shoulder strain of a user prompting the wheeled object.

2. Background Art

Many of the commercially available wheeled luggage and hand carts have an integral, rigid or retractable, structured handle which provides the user a gripping surface in a position typically perpendicular to the direction the user is pulling the luggage or cart. For instance, Shyr et al., U.S. Pat. No. 5,474,162; PCT Application No. WO93/18684; Browning, U.S. Pat. No. 3,257,120; Cowan, U.S. Pat. No. 4,852,705; Carpenter et al., U.S. Pat. No. 5,048,649 and Liang, U.S. Pat. No. 5,339,934 each disclose this type of wheeled object. Another type of commercially available wheeled luggage is shown in Gibbs, U.S. Pat. No. 5,351,793, which utilizes an unstructured, often flexible strap to pull the wheeled object.

The guiding of wheeled luggage having such integral, rigid or retractable, structured handles often causes undesirable discomfort in the arm, wrist or shoulder of frequent users of such products, such as airline employees, sales people, court reporters and the like, as a result of the unnatural positioning of the arm and wrist necessitated by the orientation of the preexisting handle of the wheeled object. In particular, the gripping portion of the preexisting handle is typically positioned for use in an orientation substantially perpendicular to the desired direction of forward and rearward motion of the wheeled object. This positioning causes an awkward under or over grip of the gripping portion, in turn, forcing the user's elbow, arm and/or wrist to be uncomfortably extended or twisted under force for extended periods of time.

There are a number of references that disclose wheeled suitcases with direction-parallel handles, including Wood, U.S. Pat. No. 3,982,613; Gregg et al., U.S. Pat. No. 4,538,709; Wickman, U.S. Pat. No. 4,679,670; and Rhaney et al., U.S. Pat. No. 5,249,438. In each of these disclosures, however, these handles are integral to their respective wheeled cases.

Another reference, namely Hansen, et al., U.S. Pat. No. 5,722,118 specifically addresses the problem of reorienting the grip on a preexisting handle of a wheeled or other slidable object. In particular, Hansen et al. is directed to a handle conversion apparatus for attachment to a preexisting handle of a wheeled object. The handle conversion apparatus comprises a hand grip having a longitudinal axis which is substantially perpendicular to the gripping portion of the preexisting handle, to convert the gripping orientation of the handle by 90°, to an orientation substantially parallel to the direction of forward and rearward motion of the wheeled object.

The invention of Hansen, et al., U.S. Pat. No. 5,722,188 has worked well with wheeled objects having preexisting handles. However, it is desired to provide a handle conversion device which enhances the ability of a user to securably retain the preexisting handle of a wheeled object, while allowing for relatively quick attachment to and release of the handle conversion device from the wheeled object. It is desired to provide these enhanced features while still providing a handle conversion device capable of reorienting the handle grip of a variety of wheeled objects to provide comfort to the user—while allowing for easy transportation of the device in a small bag or purse.

These and other objects of the present invention will become apparent in light of the present specification, claims and drawings.

SUMMARY OF THE INVENTION

The present invention is directed to a handle conversion device for facilitating movement of a wheeled object which includes a preexisting handle with a grip member having a longitudinal axis positioned in a plane substantially perpendicular to the plane defined by a desired direction of forward and rearward movement. The handle conversion device includes a hand grip, a neck and an attachment portion.

The hand grip includes a first end, a second end and a longitudinal axis positioned between the first and second ends. The longitudinal axis of the hand grip is orientated substantially perpendicular to the plane occupied by the grip member of the preexisting handle, and substantially within the plane defined by the forward and rearward movement of the wheeled object. The hand grip is preferably contoured and coated with a rubber-type material to enhance the grip.

The attachment portion includes a hook member and a retention member which act in combination to releasably yet restrainably retain the grip member of the preexisting handle, and to maintain the substantially perpendicular relationship of the hand grip for the handle conversion device to the preexisting handle. The hook member and retention member preferably create a retention zone capable of expanding to accommodate preexisting handles of varying size and dimensions.

The hook member preferably includes an attached end emanating from the neck and a free end. In a preferred embodiment, the free end of the hook member includes a curved lip portion which creates a tapered region between the free end of the hook member and the retention member to facilitate insertion of the handle grip member into the retention zone. Moreover, the hook member preferably has a substantially J-shape with an open end and a closed end, although other configurations are likewise contemplated.

The retention member preferably also includes an attached end emanating from the neck and a free end. In a preferred embodiment, the free end of the retention member includes a curved lip portion having a concave section. The concave section allows rotation of the handle grip member when positioned in the retention zone between the hook member and the retention member.

In one preferred embodiment, the retention member is preferably positioned in the open end of the hook member. Additionally, the hook member is preferably has a thickness greater than the thickness of the retention member, to prompt substantial deformation of the retention member before substantial deformation of the hook member. To this end, the retention member preferably is made from a resiliently deformable material having a memory or spring back characteristic which allows the retention member to be positioned between a deformed, retaining orientation and a resting orientation. Likewise, the hook member is preferably resiliently deformable as well.

In another preferred embodiment, the retention member is positioned outside of the open end of hook member. In this embodiment, the retention member preferably has a thickness greater than the thickness of the hook member to prompt substantial deformation of the hook member before substantial deformation of the retention member.

The handle conversion device is preferably attachable to the preexisting handle in at least two different orientations to provide a user with flexibility in finding an attachment orientation which fits his or her wheeled object carrying style.

DETAILED DESCRIPTION OF THE DRAWINGS

Figure 1:
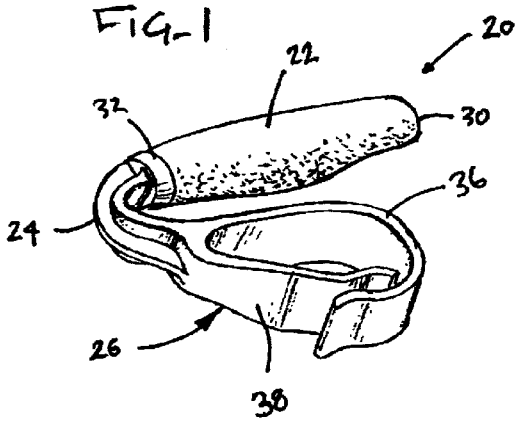
FIG. 1 of the drawings is a perspective view of the handle conversion device according to one embodiment of the present invention.
Figure 2:
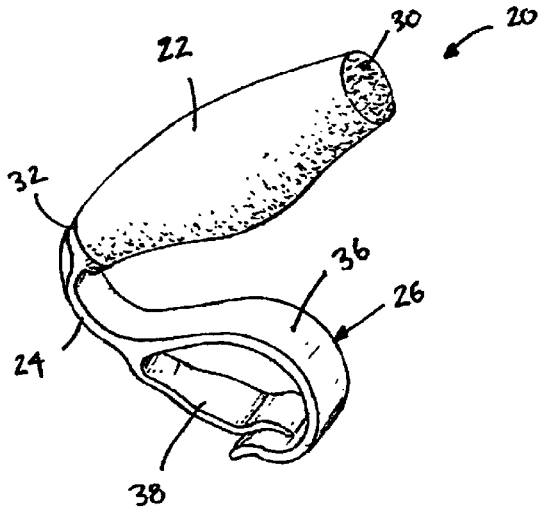
FIG. 2 of the drawings is another perspective view of the handle conversion device shown in FIG. 1.

While this invention is susceptible of embodiment in many different forms, there is shown in the drawings and will herein be described in detail several specific embodiments with the understanding that the present disclosure is to be considered as an exemplification of the principals of the invention and is not intended to limit the invention to the embodiments illustrated.

Figure 5:
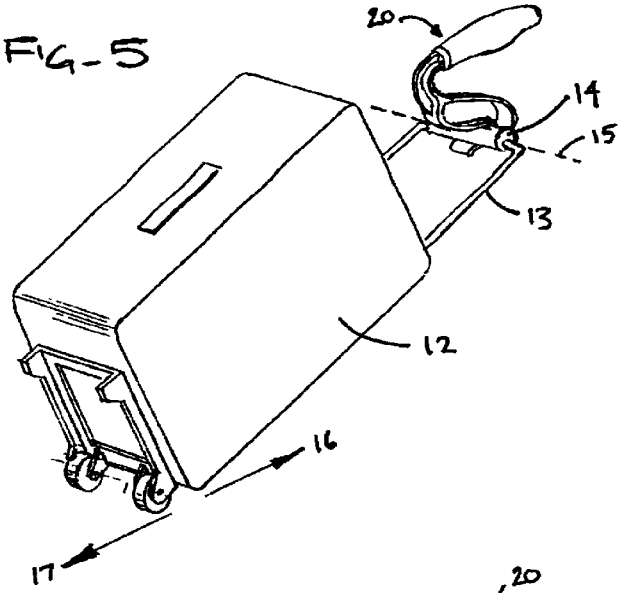
FIG. 5 of the drawings is a perspective view of the handle conversion device shown in FIG. 1, attached to a preexisting handle of a wheeled object in one orientation.
Figure 6:
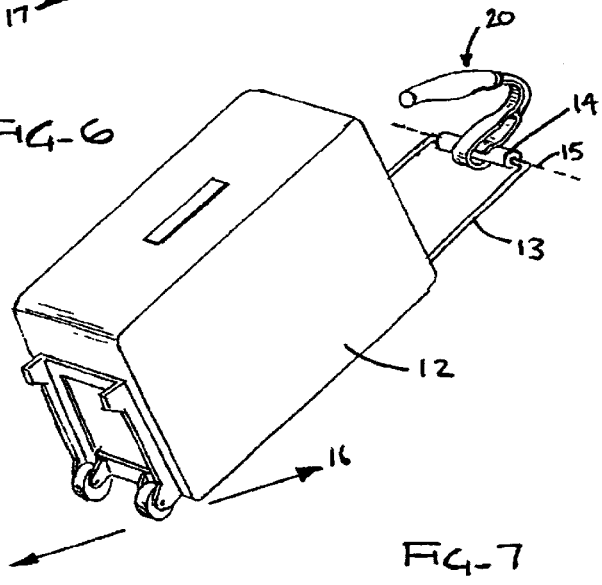
FIG. 6 of the drawings is a perspective view of the handle conversion device shown in FIG. 1, attached to a preexisting handle of a wheeled object in a second orientation.

Handle conversion device 20 is shown in FIGS. 1–7 as comprising hand grip 22, neck 24 and attachment portion 26. At the outset, handle conversion device 20 is shown in FIGS. 5 and 6 as used in combination with wheeled object 12. Wheeled object 12 is shown taking the form of a suitcase having a preexisting handle 13 with a grip member 14 defining longitudinal axis 15 lying in a plane substantially perpendicular to the plane of forward 16 and rearward 17 movement of wheeled object 12. However, it is certainly contemplated that handle conversion device 20 can be used in combination with any wheeled object having a preexisting handle with a grip member oriented perpendicular to a desired direction of movement. Further, the present invention is not limited to use with only wheeled luggage articles, as it may be used in combination with any object having a preexisting structurally rigid handle and requiring forward and rearward movement, whether that movement is accomplished on wheels, rollers, skis or even by dragging the object itself. Throughout this detailed description, like reference numerals will be used to designate like parts.

Hand grip 22 is shown in FIGS. 1–3 and 7 as including first end 30, second end 32 and longitudinal axis 34 extending between first end 30 and second end 32. Longitudinal axis 34 lies in a plane which is perpendicular to the plane occupied by longitudinal axis 15 of grip member 14 in preexisting handle 13 of wheeled object 12. Further, as can be seen from FIGS. 1–7, the plane occupied by longitudinal axis 34 preferably runs through neck 24 and attachment portion 26 and is parallel to and/or coextensive with the plane defined by forward 16 and rearward 17 movement of handle conversion device 20—to facilitate reorientation of the gripping portion of wheeled object 12.

As is shown in FIGS. 1–7, hand grip 22 is preferably contoured to enhance a user's grip. While the specific contour shown in the drawings is designed to foster an ergonomically efficient grip by a user, other contours which assist a user in grasping handle conversion device 20 and facilitate movement of wheeled object 12 are likewise contemplated, as would be known by those in the art with the present disclosure before them. Likewise, it is further contemplated that hand grip 22 may comprise a purely symmetric and/or cylindrical grip, without a specific contour. Hand grip 22 also is shown in the drawings as preferably coated with rubber or a rubber-type material to further enhance a user's grip. However, hand grip 22 need not be coated, and may be formed entirely from the material comprising the rest of handle conversion device 20. It must also be noted that while hand grip 22 is shown as a solid structure, it is likewise contemplated that hand grip may contain a hole or aperture to facilitate grasping in different orientations.

Neck 24 is shown in FIGS. 1–7 as connecting hand grip 22 and attachment portion 26. Neck 24, like attachment portion 26, is preferably formed from a plastic material to render handle conversion device 20 lightweight for ease in carrying and storage, yet durable for long-lasting use. Further, while neck 24 is shown as including a raised flange portion, a product of a beneficial manufacturing process, it is likewise contemplated that neck 24 may be a smooth, uniform, continuous piece connecting hand grip 22 and attachment portion 26. Indeed, neck 24 may comprise virtually any configuration which connects hand grip 22 and attachment portion 26. Of course, it is likewise contemplated that attachment portion 26 may directly emanate from hand grip 22, thus obviating the need for a separate neck.

Attachment portion 26 is shown in FIGS. 1–7 as including hook member 36, retention member 38 and retention zone 40. As can be seen from the drawings, attachment portion 26 preferably lies in the same plane as longitudinal axis 34 of hand grip 22, a plane which is perpendicular to that occupied by grip member 14 on preexisting handle 13 of wheeled object 12, and a plane which is parallel to or overlapping with the plane defined by forward movement 16 and rearward movement 17 of wheeled object 12. Hook member 36 and retention member 38 preferably emanate, at respective attached ends 42 and 48, from neck 24. Alternatively, hook member 36 and retention member 38 may have different origination points rooted in either neck 24 or hand grip 22.

Hook member 36 preferably includes attached end 42, free end 44, closed portion 45 and open portion 47. While hook member 36 is shown in the drawings as comprising a substantially J-shaped member, it is likewise contemplated that hook member 36 need not be J-shaped, or even a hook configuration. Indeed, hook member 36 may comprise a substantially straight retaining piece, similar to retention member 38, or have other alternative configurations as would be known to those with ordinary skill in the art with the present disclosure before them. However, for purposes of this description, hook member 36 will be described as having a substantially J-shape.

Figure 3:
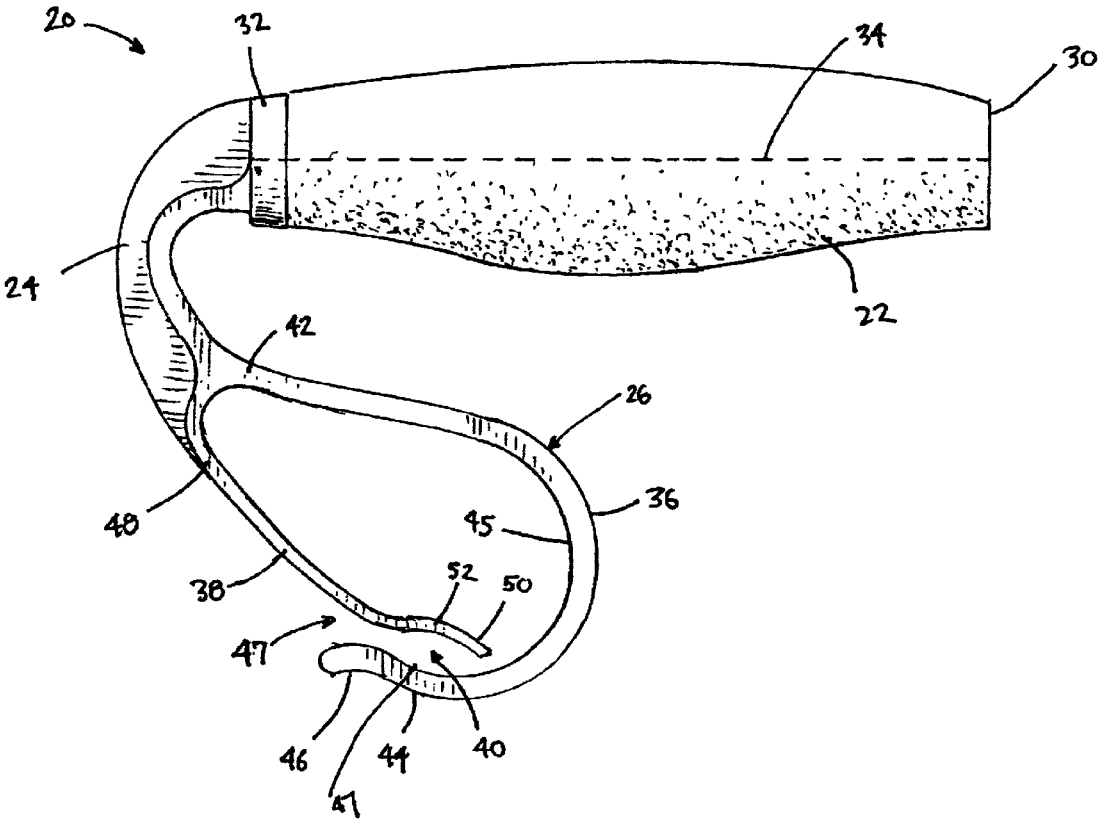
FIG. 3 of the drawings is a side elevational view of the handle conversion device shown in FIG. 1.
Figure 4:
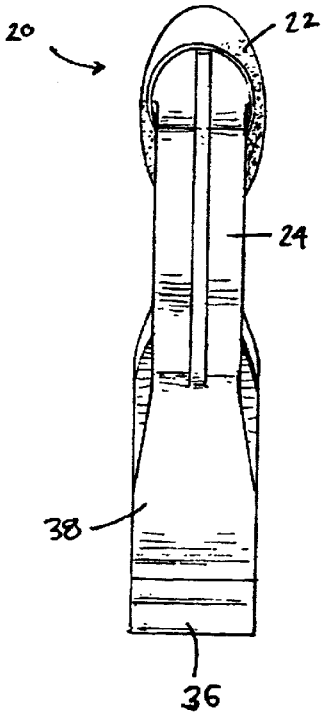
FIG. 4 of the drawings is a front elevational view of the handle conversion device shown in FIG. 1.
Figure 7:
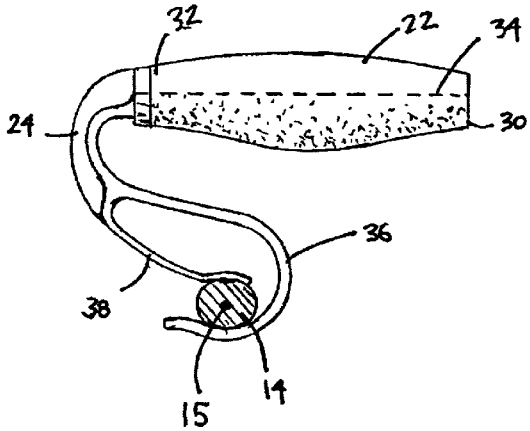
FIG. 7 of the drawings is a side elevational view of the handle conversion device shown in FIG. 1, attached to a preexisting handle.

As is shown in FIGS. 3 and 7, free end 44 of hook member 36 preferably includes a curved lip portion 46. Curved lip portion 46 preferably flares outwardly to create a tapered region between free end 44 of hook member 36 and retention member 38, to facilitate insertion of grip member 14 of preexisting handle 13 into retention zone 40. In particular, the tapered region formed between curved lip portion 46 and retention member 38 prompts deformation of retention member 38 upwards, and allows for deformation of the hook member 36 downward, upon insertion of grip member 14 into retention zone 40. Further, curved lip portion 46 creates a nesting zone 47 on the inside surface of hook member 36, which assists in releasably securing grip member 14 in retention zone 40 and minimizing the ability of grip member 14 to inadvertently release therefrom.

As is shown in FIG. 3, retention member 38 comprises attached end 48 and free end 50. Retention member 38 is resiliently deformable, and preferably positioned in open portion 47 of hook member 36. Thus, upon prompting, retention member 38 can be moved or deformed to any number of positions inside hook member 36, such as that shown in FIG. 7, to accommodate preexisting handles of varying sizes and shapes, while still substantially returning to its original position shown in FIG. 3. This "memory" or "spring-back" characteristic likewise causes retention member 38 to exert a biased, downward force on hand grip 14 (shown in FIG. 7), or on any other preexisting handle, to releasably retain the preexisting handle in retention zone 40 of attachment portion 26.

Free end 50 of retention member 38 also includes a curved lip portion 52, which is preferably concave. Curved lip portion 52 acts in combination with free end 44 of hook member 36 to create retention zone 40, which is preferably tailored to releasably retain preexisting handles having at least a portion which is curved or rounded. To this end, the curved portion of free end 50 of retention member 38 acts in combination with the curved portion of hook member 36 to allow rotation of handle conversion device 20 about grip member 14 of preexisting handle 13. This rotation, in turn, allows transition of wheeled object 12 from a resting position to a transporting or wheeling position, shown in FIGS. 5 and 6—while maintaining preexisting handle 13 in a releasably retained orientation inside attachment portion 26. Rotation of handle conversion device 20 further permits adjustments in the orientation of and relationship between handle conversion device 20 and preexisting handle 13 as a user transports wheeled object 12 during use. For instance, a user's hand and/or arm typically moves at least slightly up and down when a user is walking and/or running through an airport, down the street, in a hotel, or moving between locations.

Moreover, as is shown in FIGS. 3 and 7, retention member 38 preferably has a thickness which is less than the thickness of hook member 36. This differences in thickness preferably prompts deformation of retention member 38 before substantial deformation of hook member 36 upon insertion of grip member 14 of preexisting handle 13 into retention zone 40 of attachment portion 26. As can be seen by comparing the orientation of retention member 38 in its resting position in FIG. 3, with one of its retaining positions shown in FIG. 7, retention member 38 preferably undergoes more deformation and movement than hook member 36. Indeed, inasmuch as retention member 38 is preferably made from a resiliently deformable material which has a memory enabling deformation and return to its original orientation, handle conversion device 20 may be used repeatedly over time, and in combination with any preexisting handles having any number of sizes and/or configurations. Hook member 36 is also preferably made of the same resiliently deformable material as retention member 38, and thus will likewise have some memory allowing for prompted movement upon insertion of grip member 14 into retention zone 40.

It must also be noted that retention member 38 is preferably of a thickness which securely holds grip member 14 in retention zone 40 during use and transportation of wheeled object 12, but which also allows simple and relatively effortless release of grip member 14 from attachment portion 26. This construction enables quick and easy attachment and detachment of handle conversion device 20 from wheeled object 12 between times when the wheeled object is moved by a user, and times when the wheeled object is placed in a resting location, such as a vehicle, an airplane, a hotel room, an office, a closet, etc.

Of course, it is likewise contemplated that retention member 38 may have a thickness substantially equivalent to the thickness of hook member 36, in which case both hook member 36 and retention member 38 tend to deform more equally upon insertion of grip member 14 into retention zone 40. Likewise, it is also contemplated that retention member has a greater thickness than hook member 36, such as that shown in FIG. 8, to prompt equal or more substantial deformation of hook member during insertion of grip member 14 into retention zone 40 of attachment portion 26. Moreover, while free ends 44 and 50 of hook member 36 and retention member 38, respectively, are shown as constructed to accommodate a circular or round grip member, the shape and contour of the free ends may be altered to enhance use with a preexisting handle having other shapes.

In operation, and is shown in FIGS. 5 and 6, grip member 14 of preexisting handle 13 is positioned between hook member 36 and retention member 38 into retention zone 40 of attachment portion 26. This places longitudinal axis 34 of hand grip 22 and handle conversion device 20 as a whole in a plane substantially perpendicular to that occupied by longitudinal axis 15 of grip member 14, and in a plane substantially parallel or coextensive with the plane defined by forward movement 16 and rearward movement 17 of wheeled object 12. This reorientation of the gripping portion of wheeled object 12 minimizes contortion of a user's arm, particularly a user's elbows and wrists, which results from holding grip member 14 while propelling wheeled object 12 in forward and rearward directions 16 and 17. Handle conversion device 20 removes and/or minimizes contortion strain, which can lead to various shoulder, wrist and/or elbow problems, particularly in frequent travelers, such as flight crews, sales people and others who often use various types of wheeled objects such as luggage cases, hand carts and the like.

Further, as is shown in FIGS. 5 and 6, handle conversion device 20 may be attached to preexisting handle 13 of wheeled object 12 in at least two different orientations to provide a user with flexibility in how he or she prefers to push or pull his or her wheeled objects. Notably, both orientations achieve the ultimate goal of reorienting the grip to a more user-friendly, strain-minimizing orientation in the plane of forward and rearward movement of the wheeled object.

Figure 8:
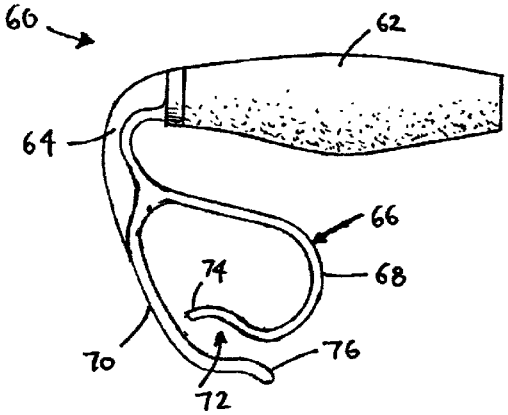
FIG. 8 of the drawings is a side elevational view of a handle conversion device according to another embodiment of the present invention.

In another embodiment, shown in FIG. 8, handle conversion device 60 includes hand grip 62, neck 64 and attachment portion 66. Like attachment portion 26 of handle conversion device 20, attachment portion 66 of handle conversion device 60 also includes hook member 68, retention member 70 and retention zone 72. However, instead of positioning the retention member inside of the hook member, hook member 68 is positioned inside the opening created by retention member 70. Free end 74 of hook member 68 and free end 76 of retention member 70 are still preferably curved to facilitate insertion of a grip member into retention zone 72, to enhance retention of the grip member inside the retention zone and to permit rotation of handle conversion device 60 about a preexisting handle.

Moreover, as can be seen from FIG. 8, retention member 70 preferably has a thickness which is greater than that of hook member 68, prompting greater deformation of free end 74 of hook member 68 than free end 76 of retention member 70 upon insertion of a preexisting handle into retention zone 72. Further, as was described with respect to the configuration of hook member 36 on handle conversion device 20, hook member 68 of handle conversion device 60 need not have the "J" configuration as shown, nor be a hook at all. Indeed, hook member 68 may comprise a substantially "L" shaped member, such as retention member 70, for releasably retaining a preexisting handle between hook member 68 and retention member 70, or take other configurations even flatter than an L-shaped element, as would be known by those with ordinary skill in the art with the present disclosure before them. Finally, like attachment portion 26, hook member 68 and retention member 70 of attachment portion 66 may have similar thicknesses, or differing reversed thicknesses from that shown in FIG. 8.

The foregoing description and drawings merely explain and illustrate the invention and the invention is not limited thereto except insofar as the appended claims are so limited as those skilled in the art with present disclosure before them will be able to make modifications and/or variations therein without departing from the scope of the invention.

What is claimed is:

1. A handle conversion device for facilitating movement of a wheeled object having a preexisting handle with a grip member having a longitudinal axis positioned in a plane substantially perpendicular to a desired direction of movement, said handle conversion device comprising:

a hand grip having a first end, a second end and a longitudinal axis positioned between the first and second ends, said longitudinal axis of said hand grip being oriented substantially perpendicular to the plane occupied by the grip member of the preexisting handle and substantially within the same plane defined by forward and backward movement of the wheeled object;

an attachment portion operably associated with said hand grip for operable attachment to said grip member of said preexisting handle of said wheeled object, said attachment portion including at least one hook member and at least one retention member, said at least one hook member and said at least one retention member acting in combination with one another to exert a biased force about the grip member at one or more positions about same, to releasably yet restrainably retain said grip member of said preexisting handle to, in turn, maintain the substantially perpendicular relationship of said hand grip longitudinal axis and said grip member longitudinal axis to facilitate controlled attachment and movement of said wheeled and said attachment portion further including a retention zone at which said biased force is exerted about said grip member, said retention zone defined between at least a portion of said at least one retention member and at least a portion of said at least one hook member, said retention zone being capable of expanding to releasably and alternatively accept and release said grip member from said controlled restraint.

2. The handle conversion device according to claim 1 wherein said at least one hook member is substantially J-shaped and includes an open end and a closed end.

3. The handle conversion device according to claim 2 wherein said at least one retention member is positioned at least partially within the open end of said at least one hook member to facilitate retention of said handle grip member in said attachment portion of the handle conversion device.

4. The handle conversion device according to claim 2 wherein said at least one retention member is positioned at least partially outside of said open end of said at least one hook member.

5. The handle conversion device according to claim 1 wherein said grip member is releasably retained between at least a portion of said at least one retention member and at least a portion of said at least one hook member in said attachment portion.

6. The handle conversion device according to claim 5 wherein said at least one retention member is resiliently deformable to facilitate movement between a resting orientation and a retaining orientation upon the insertion, retention and removal of said grip member between said at least one retention member and said at least one hook member.

7. The handle conversion device according to claim 6 wherein said retention member is biased to said resting orientation.

8. The handle conversion device according to claim 6 wherein said at least one retention member and said hook member are at least partially resiliently deformable to facilitate insertion of said grip member therebetween to, in turn, exert a biased force thereupon.

9. The handle conversion device according to claim 1 wherein said each of said at least one hook member and said at least one retention member have at least one free end unattached to any other portion of said handle conversion device.

10. The handle conversion device according to claim 9 wherein said free end of said hook member includes a curved lip which creates a tapered introduction region between said hook member and said retention member to facilitate insertion of said grip member of said preexisting handle into said attachment portion.

11. The handle conversion device according to claim 1 wherein said attachment portion is connected to said hand grip by a neck.

12. The handle conversion device according to claim 1 wherein said at least one retention member includes at least one concave portion to facilitate releasable retention of said handle grip member in said attachment portion of said handle conversion device.

13. The handle conversion device according to claim 1 wherein said at least one hook member and said at least one retention member each have a thickness, and wherein the thickness of said at least one hook member is greater than the thickness of said at least one retention member to prompt greater deformation of said at least one retention member than said at least one hook member upon insertion of said handle grip member into said attachment portion.

14. The handle conversion device according to claim 1 wherein said at least one hook member and said at least one retention member releasably retain said handle grip member in said attachment portion such that said handle conversion device is capable of rotating about said preexisting handle while maintaining the controlled restraint thereof, to facilitate transition of said wheeled object and said preexisting handle between different angular orientations.

15. The handle conversion device according to claim 1 wherein said attachment portion provides at least two different attachment orientations in which said handle conversion device may be releasably attached to said preexisting handle of said wheeled object, to provide multiple grasping orientations for a user of said handle conversion device.

16. A combination comprising:

a wheeled object including a preexisting handle with a grip member having a longitudinal axis positioned in a plane substantially perpendicular to a desired direction of movement, a handle conversion device for facilitating movement of said wheeled object, said handle conversion device including a hand grip and an attachment portion;

said hand grip having a first end, a second end and a longitudinal axis positioned between the first and second ends, said longitudinal axis of said hand grip being oriented substantially perpendicular to the plane occupied by the grip member of the preexisting handle and substantially within the same plane defined by forward and backward movement of the wheeled object;

an attachment portion operably associated with said hand grip for operable attachment to said grip member of said preexisting handle of said wheeled object, said attachment portion including at least one hook member and at least one retention member, said at least one hook member and said at least one retention member acting in combination with one another to exert a biased force about the grip member at one or more positions about same, to releasably yet restrainably retain said grip member of said preexisting handle to, in turn, maintain the substantially perpendicular relationship of said hand grip longitudinal axis and said grip member longitudinal axis to facilitate controlled attachment and movement of said wheeled and said attachment portion further including a retention zone at which said biased force is exerted about said grip member, said retention zone defined between at least a portion of said at least one retention member and at least a portion of said at least one hook member, said retention zone being capable of expanding to releasably and alternatively accept and release said grip member from said controlled restraint.

* * * * *